US007381303B2

(12) United States Patent
Sidhu et al.

(10) Patent No.: US 7,381,303 B2
(45) Date of Patent: Jun. 3, 2008

(54) SYSTEM AND METHOD FOR CONTROLLING A THERMO-MECHANICAL WOOD PULP REFINER

(75) Inventors: Manpreet S. Sidhu, North Vancouver (CA); Richard J. Van Fleet, Cave Creek, AZ (US); Michel R. Dion, Glendale, AZ (US)

(73) Assignee: Honeywell International Inc., Morristown, NJ (US)

( * ) Notice: Subject to any disclaimer, the term of this patent is extended or adjusted under 35 U.S.C. 154(b) by 482 days.

(21) Appl. No.: 11/014,336

(22) Filed: Dec. 16, 2004

(65) Prior Publication Data

US 2005/0263259 A1 Dec. 1, 2005

Related U.S. Application Data

(60) Provisional application No. 60/566,149, filed on Apr. 27, 2004.

(51) Int. Cl.
*D21C 7/12* (2006.01)

(52) U.S. Cl. ..... 162/238; 162/23; 162/19; 700/9; 700/44; 700/28; 241/21; 241/28; 241/16

(58) Field of Classification Search ..... 162/238, 162/23, 19; 700/9, 44, 28; 241/21, 28, 16
See application file for complete search history.

(56) References Cited

U.S. PATENT DOCUMENTS 4,088,528 A 5/1978 Berger et al. ..... 162/19
4,145,246 A 3/1979 Goheen et al.
4,231,842 A 11/1980 Ojala
4,253,613 A 3/1981 Reinhall ..... 241/16
4,421,595 A 12/1983 Huusari
5,016,824 A 5/1991 Pietinen et al.
5,351,184 A 9/1994 Lu et al. ..... 364/165
6,055,483 A 4/2000 Lu ..... 702/31
6,122,555 A 9/2000 Lu ..... 700/9
6,361,650 B1 3/2002 Danielsson et al.

OTHER PUBLICATIONS

Du, Huaijing, "*Multivariable Predictive Control of a TMP Plant*", University of British Columbia, Thesis submitted for requirements of PhD., Oct. 1998.

Strand, William C., et al., "*Mill-wide Advanced Quality Control for the Production of Newsprint*", paper from IMPC Conference, 2001.

*Primary Examiner*—Mark Halpern
(74) *Attorney, Agent, or Firm*—Cascio, Schmoyer & Zervas

(57) ABSTRACT

Thermomechanical pulp is an important process for producing fibrous mass used in papermaking. A two-level control strategy that stabilizes and optimizes the refining process has been developed. The Stabilization layer consists of a multivariable model predicative range controller that regulates the refiner line operations. The Quality Optimization layer provides the pulp quality control as measured by an online pulp quality (freeness, fibre length) sensor. This control startegy leverages the natural decoupling in the process. The modular design technique is able to handle multiple refiner lines that empty into a common latency chest. A global optimizer is also used to integrate and coordinate the two layers for enhanced constraint handling.

9 Claims, 3 Drawing Sheets

SYSTEM AND METHOD FOR CONTROLLING A THERMO-MECHANICAL WOOD PULP REFINER

CLAIM OF PRIORITY

This application claims priority to U.S. Provisional Patent Application No. 60,566,149, filed on Apr. 27, 2004 (Honeywell Ref. I2407025US).

FIELD OF THE INVENTION

This invention relates to pulp refining and papermaking and particularly to techniques for controlling the production and the quality of the pulp used in a papermaking process.

BACKGROUND OF THE INVENTION

Processes for making paper pulp consist in reducing the raw materials to separate fibers containing a greater or lesser amount of cellulose depending on the qualities which the pulp produced is required to have. The processes essentially consist of grinding operations, which are basically mechanical, which may be combined with more or less powerful delignification operations, which are basically chemical.

Depending on the relative importance of the two treatments, it is possible to distinguish five major types of pulp:

(1) Mechanical pulp, obtained by grinding without any chemical treatment beforehand of the raw material;

(2) Thermo-mechanical pulp, obtained by grinding under pressure, which is made easier by steaming the raw material beforehand to soften the lignin;

(3) Mechano-chemical pulp, obtained by grinding in combination with in situ or ex situ preliminary treatment of the raw material with chemical reagents;

(4) Semi-chemical pulp, obtained by grinding raw material which is previously subjected to partial chemical "cooking" under pressure; and (5) Chemical pulp, where the chemical processing is much more powerful and produces both the delignification and the major part of the reduction to fiber.

Refiner mechanical pulp (RMP) is produced by the mechanical reduction of wood chips (and sometimes sawdust) in a disc refiner. The process usually involves the use of two refining stages operating in series, i.e., two-stage refining, and produces a longer-fibered pulp than conventional ground wood. As a result, it is stronger, freer, bulkier, but usually somewhat darker in color, than stone ground wood. Thermomechanical pulping (TMP) was the first major modification of RMP, and is still employed on a large scale to produce high-tear pulps for newsprint and board. This process involves steaming the raw material under pressure for a short period of time prior to and during refining. The steaming serves to soften the chips, with the result that the pulp produced has a greater percentage of long fibers and fewer shives than RMP.

It is becoming increasingly important to produce TMP pulp that is both uniform and of a high quality. Papermakers desire to optimize paper machine operations, and in some instances to replace the expensive kraft furnish. Even though advanced process control has gained general acceptance in the pulp and paper industry, the thermo-mechanical pulping process is still under manual control in most pulp mills. Reliance on manual control stems primarily from the complexity of the TMP process, which is highly interactive requiring control and variable inputs from many sections of the refining process. Additionally, control of the TMP process is further complicated as blow-line consistency in most cases is not measured using an online sensor. Pulp quality descriptive variables such as fiber length and freeness are also measured infrequently.

In order to produce high quality thermo-mechanical pulp, the refining process must be under tight control. Closed loop control of a TMP refiner system is one of the most complex and challenging control problems in a pulp mill. The process is inherently multivariable, exhibiting strong interactions. In addition, the bandwidth of the process outputs is spread over a wide frequency range. For example, the open loop response between the primary plate gap to the primary motor load and final pulp freeness is about 2 minutes and about 90 minutes, respectively. The refining process is also complicated by non-stationary process dynamics due to wear of the refiner plates.

In the past, TMP controller design was attempted using single-loop PID based decentralized control architecture. The choice of decentralized architecture was appealing as it was easy to understand by mill personnel and simple to implement using the existing distributed control system (DCS). Proportional-integral-derivative (PID) based control strategy is acceptable for regulation of local control loops such as flow and pressure regulation, but a PID controller cannot handle complex multivariable dynamics. In addition, a PID controller can only control a single process output. However, to adequately control pulp quality at least two variables such as, for example, Canadian standard freeness (CSF) and mean-fiber length (MFL) must be controlled. Since these variables are physically linked, they cannot be independently controlled to arbitrary targets, instead these variables must be controlled within an operator defined quality window. The quality window is defined by setting the upper and lower limits on the pulp quality variables. In order to handle this control problem a multivariable controller is required that can also handle process constraints. Constrained model based predictive control (MPC) is a natural candidate in the process industrial. MPC provides a unified framework to efficiently handle complex process interactions and constraints. MPC technology has also gained industrial acceptance and it can be easily integrated into existing mill DCS platforms.

The use of MPC to control a refiner system has been presented by Du, H., entitled, *Multivariable predictive control of a TMP plant*, Ph.D. dissertation, UBC, Vancouver, BC, Canada, 1998. The study was presented at a theoretical level that demonstrated the need to control the refining intensity. However, no attempt was made to directly control the pulp quality. Other work by Strand, W. C., et al., IMPC 2001 discusses the use of MPC but the details of the control strategy are not disclosed.

SUMMARY OF THE INVENTION

The present invention is based in part on the recognition that decentralized control architecture and strategy can be extended into a centralized controller design framework. However, this strategy cannot be directly extended to a centralized framework by utilizing a single MPC controller. Since the process dynamics are spread over a wide frequency range, a single MPC, executing at a fixed frequency, would not be able to provide adequate control of both fast and slow dynamics. In order to mitigate this problem, a two-level control strategy has been developed.

The present invention applies MPC technology in a two-level control strategy that can control the entire TMP refining line to increase throughput, reduce energy usage and improve pulp quality. The control strategy leverages the natural decoupling in the process dynamics. As a result, Model Predicitive Range Control controllers can be designed to independently regulate the fast and slow dynamics of the process. The first level is the Stabilization Controller that preferably regulates the refiner line motor loads and the blow-line consistencies. The second level is the Quality Controller that preferably controls the slow dynamics associated with the pulp quality variables. The Quality Controller can directly manipulate the plate gap to control the final pulp quality. The direct manipulation of the plate gap removes the requirement to implement an internal specific energy loop. However a specific energy loop on each refiner can be included without impacting the nature of this invention. In this control strategy the designer can independently select the execution frequency of the two levels. By operating the refiner lines at the maximum allowable motor loads the production is automatically maximized for a given pulp quality window. This modular approach can also handle multiple refiner lines that empty into a common latency chest. In order to integrate and coordinate the Stabilization and Quality Controllers, an Optimizer based on distributed quadratic programming was also developed. The Optimizer performs a global optimization of the process and improves the overall constraint handling of the control strategy.

In one embodiment, the invention is directed to a system to support centralized control for thermo-mechanical pulp (TMP) refining, that includes:

one or more stabilization controllers each operable to handle the fast dynamics of the TMP refining process;

one or more quality controllers each operable to handle the slow dynamics of the TMP refining process; and an optimizer operable to integrate and/or coordinate the one or more stabilization and quality controllers to control the entire TMP refining process.

In another embodiment, the invention is directed to a method to support centralized control for thermo-mechanical pulp (TMP) refining, that includes:

handling the fast dynamics of the TMP refining process via one or more stabilization controllers;

handling the slow dynamics of the TMP refining process via one or more quality controllers; and integrating and/or coordinating the one or more stabilization and quality controllers to control the entire TMP refining process via an optimizer.

In a further embodiment, the invention is directed to a system to support centralized control for thermo-mechanical pulp (TMP) refining, that includes:

means for handling the fast dynamics of the TMP refining process via one or more stabilization controllers;

means for handling the slow dynamics of the TMP refining process via one or more quality controllers; and means for integrating and/or coordinating the one or more stabilization and quality controllers to control the entire TMP refining process via an optimizer.

DETAILED DESCRIPTION OF THE PREFFERED EMBODIMENTS

The present invention is directed to techniques for controlling a thermo-mechanical pulp (TMP) process by which wood (or other fibrous raw material) is reduced to a fibrous mass which is used in papermaking. A TMP process can employ a single refiner line that empties into a latency chest or it may employ a plurality of parallel refiner lines that empty into a common latency chest. Each refiner line includes at least one refiner and preferably each line includes two or more refiners that are connected in series.

The present invention can be applied to control any of the individual refiner lines in a TMP process. Thus, the phrase the "entire" TMP process (or "entire" TMP refining process) is meant the process that is encompassed by a refiner line.

While the invention will be illustrated in connection with a single refiner line (with two refiners in the line) of a TMP process, it is understood that the present invention is applicable to any TMP process that includes at least one refiner line wherein each refiner line has at least one refiner. Moreover, while it is preferred that the refiner lines in a multiple refiner line TMP all have the same number of refiners, it is not necessary. Thus, as an example, the present invention is applicable to a TMP process that consists of four parallel refiner lines where each refiner line has a different number of refiners. Each refiner line can be controlled with the present invention.

TMP refining processes and refiner devices are known in the art and are described, for example, in U.S. Pat. No. 6,361,650 to Danielsson, et al., U.S. Pat. No. 5,016,824 to Pietinen et al., U.S. Pat. No. 4,231,842 to Ojala, U.S. Pat. No. 4,145,246 to Goheen et al., and U.S. Pat. No. 4,421,595 to Huusari, *Handbook for Pulp & Paper Technologists* 2nd ed., G. A. Smook, 1992, Angus Wilde Publications, Inc., and Pulp and Paper Manufacture Vol III (Papermaking and Paperboard Making), R. MacDonald, ed. 1970, McGraw Hill, and Du, H., entitled, *Multivariable predictive control of a TMP plant*, Ph.D. dissertation, UBC, Vancouver, BC, Canada, 1998, which are all incorporated herein by reference.

Figure 1:
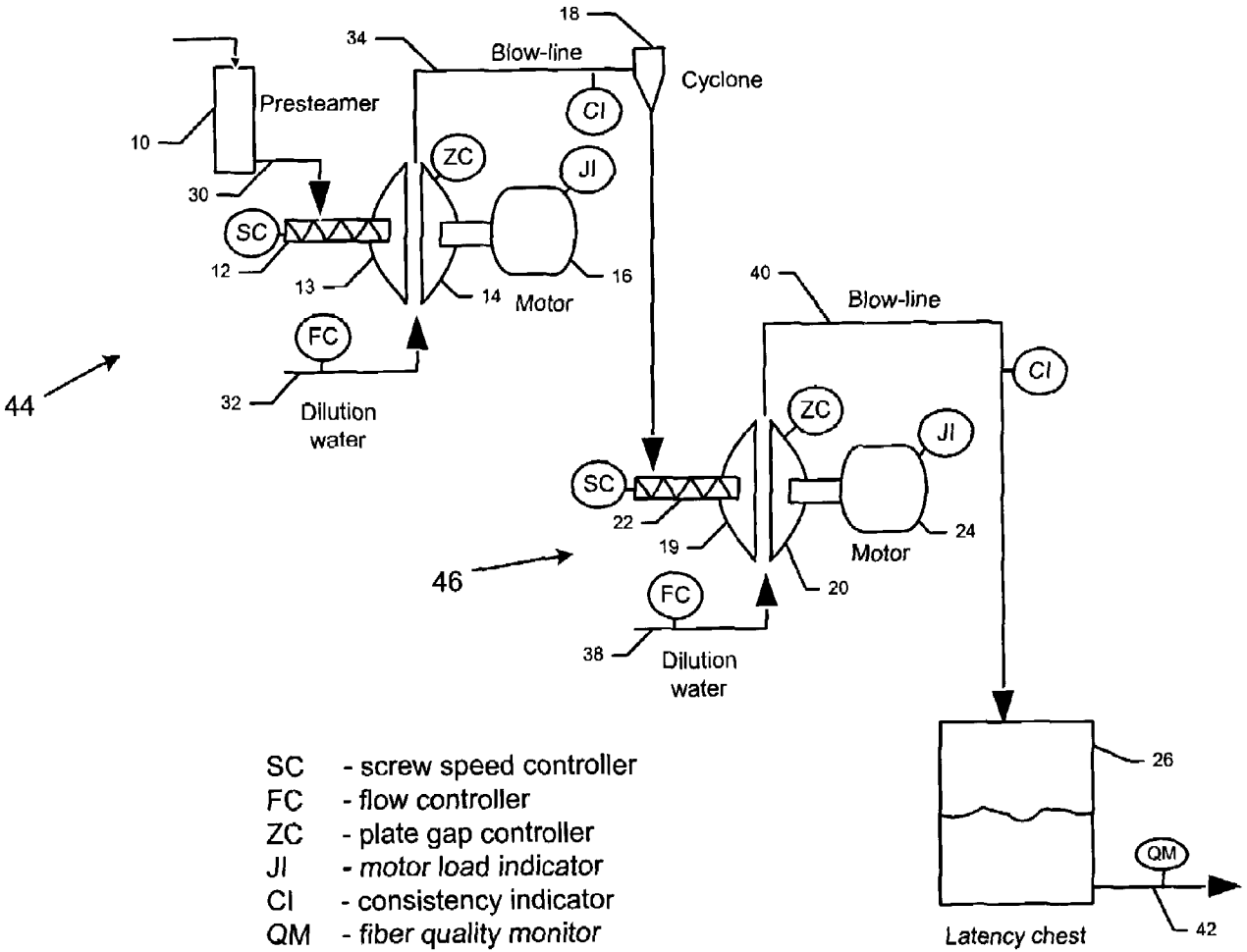
FIG. 1 is a flow diagram illustrating a refining line of a TMP process.

FIG. 1 illustrates a refiner line that includes a primary refiner (PR) 44 and a secondary refiner (SR) 46 that are configured in series. The refiners are preferably disc refiners. This refiner line, for instance, can be one of four parallel lines that empty into a common latency chest. The primary refiner 44 has a feed screw 12, discs 13, 14, and a motor 16. The plate gap distance is the separation of the two discs 13, 14. Water is fed to the refiner via line 38. Similarly, the secondary refiner 46 has a feed screw 22, discs 19, 22, and a motor 24. Water is supplied to the secondary refiner via line 36. Suitable refiners are commercially available; a preferred refiner is the Sunds CD70 refiner. A commercially available true disc clearance system can be used to regulate the plate gaps.

Raw materials, e.g., chip feed, enters the preseteamer 10 of the refiner line. The presteamer 10 preferably can use both mill steam and recycled process steam to increase the chip temperature, typically to 180° C. Presteaming removes entrained air from the wood chips and induce lignin softening. The screw speed determines the volumetric feed rate to the primary refiner 44. Following the primary refiner 44 via primary blow-line 34 is a pressure cyclone 18 that separates the semi-refined pulp and steam from the primary blow-line. The steam from the cyclone 18 is vented to the atmosphere or recovered in a steam recovery system.

From the cyclone 18, the semi-refined pulp is then fed into the secondary refiner 46 for further fiber development. At the exit of the secondary refiner 46 via secondary blow-line 40 is the latency chest 26. The latency chest 26 allows the beaten fibers to relax in hot water to remove latency. At the exit 42 of the latency chest 26 is a fiber quality monitor (QM) that collects samples and determines pulp quality parameters such as CSF and MFL.

As shown FIG. 1, the refiner line also includes various controller and indicators strategically positioned along the refiner line. These instruments are all commercially available and are usually present in existing TMP mills. The true gap controller (ZC) can be substituted with a hydraulic pressure controller. An in-line blow-line consistency indicator may not be present at all mills. In the absence of an in-line sensor, software sensor based on first principle (mass & energy balances) modeling and/or empirical (multivariable statistical data analysis) modeling techniques can be used to predict blow-line consistency.

Model Predictive Controller and Global Optimizer

This present invention implements a two-level control strategy that stabilizes and optimizes the TMP refining process. As further described herein, a Stabilization Layer using a Model Predictive Controller (MPC) regulates the refiner line operations. The invention preferably employs a Robust Multivariable Predictive Controller using Range Control, also known as, Model Predictive Range Control (MPRC) as described in U.S. Pat. No. 5,351,184 to Lu et al. and entitled, Method Of Multivariable Predictive Control Utilizing Range Control, assigned to Honeywell International Inc. and which is incorporated herein by reference. In addition, a Quality Optimization layer provides the pulp quality control as measured by an online pulp quality (freeness, fiber length) sensor. This control strategy leverages the natural decoupling in the process. The modular design technique is able to handle multiple refiner lines that empty into a common latency chest.

Finally, a Global Optimizer is used to integrate and coordinate the two layers for enhanced constraint handling. The Global Optimizer is preferably implemented using the techniques described in U.S. Pat. No. 6,055,483 to Zhuxin J. Lu and entitled, Systems And Methods Using Bridge Models To Globally Optimize A Process Facility and U.S. Pat. No. 6,122,555 to Zhuxin J. Lu and entitled, System And Methods For Globally Optimizing A Process Facility, both of which are assigned to Honeywell International Inc. and are incorporated herein by reference.

Process Modeling and Analysis

The typical TMP process exhibits very strong interactions that lends to constructing a multivariable model. For example, a change in the feed screw speed will affect the primary refiner motor load and blow-line consistency. The increase in the feed screw speed will also affect the operations of the secondary refiner. However, the changes in SR dilution and SR plate gap do not impact the runnability of the PR refiner.

The manipulated variables (MVs) and controlled variables (CVs) of the exemplary process are listed in Table 1. As is apparent, while these are representative of key variables, other TMP process variables can be manipulated and controlled.

TABLE 1

| MVs | CVs |
|---|---|
| Screw speed | PR motor load |
| PR dilution flow | PR blow-line consistency |
| PR plate gap | SR motor load |
| SR dilution flow | SR blow-line consistency |
| SR plate gap | Final pulp quality (MFL, CSF, Shives, Fiber length distribution) |
| Chemical addition | PR blow-line pulp quality (MFL, CSF, Shives, Fiber length distribution) |
| | SR blow-line pulp quality (MFL, CSF, Shives, Fiber length distribution) |
| | PR specific energy |
| | SR specific energy |
| Steam flow | Total specific energy (PR + SR) |
| | Power split ratio between PR and SR |

It should be noted that even though each refiner line may have the same refiner machines, there may be some mechanical differences. For example, some refiners have dilution flow at the flat zone while other have dilution at the conical zone. Because of these mechanical differences, the process models between various refiner lines can be quite different.

Figure 2:
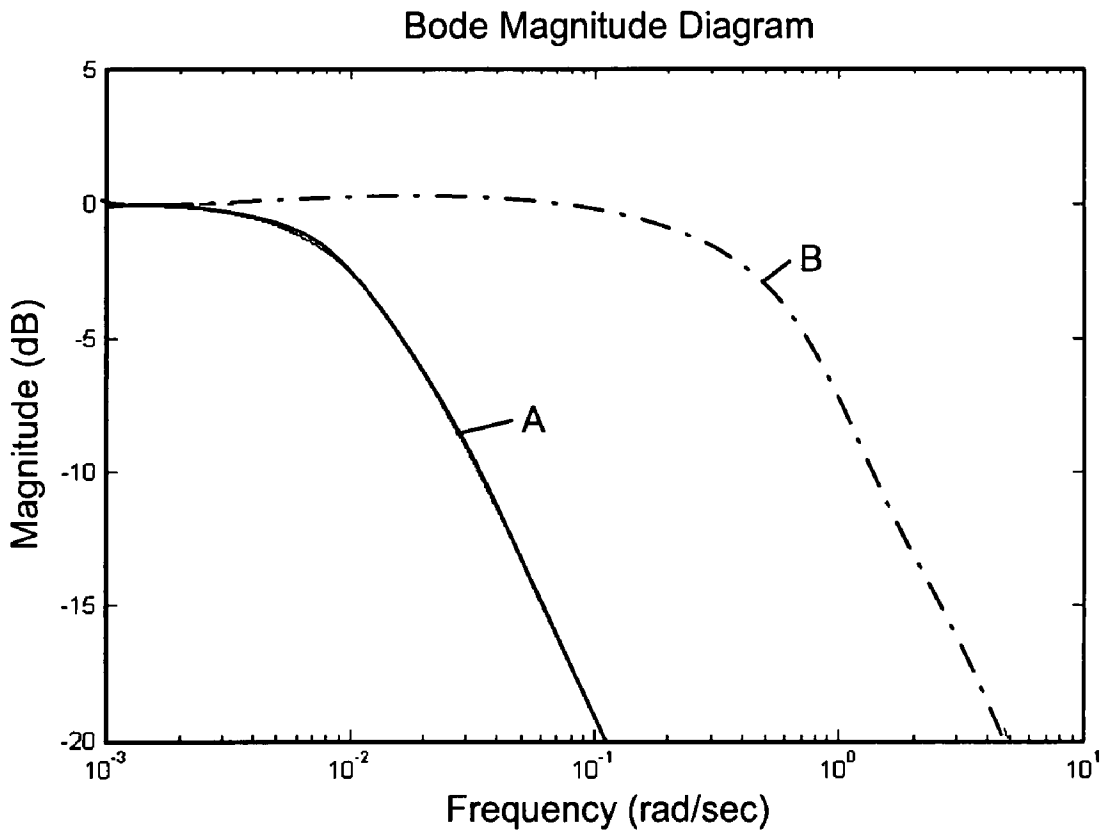
FIG. 2 is a Bode Magnitude Diagram of the frequency response of the primary motor load and CSF to plate gap changes.

First orders with dead-time transfer functions were sufficient to model the refining process. The refiner process has some extremely fast and some very slow process dynamics. For example, the time constant of the model between the primary plate gap and the motor load was about two minutes. However, the response of the quality variables was much slower. The time constant between the primary plate gap and CSF was approximately 90 minutes. This large difference in the open loop process bandwidth of the process is due to the location of the QM. The QM is located after the latency chest, and as a result the dynamics of the latency chest are lumped into the response of the quality variables. This is an example of how the placement of a sensor can significantly impact the process response. The frequency response of the primary motor load (curve A) and CSF (curve B) are illustrated in FIG. 2 The gains have been normalized to unity for ease of comparison.

Based on the identification results and the difference in the frequency response, the process was decoupled and split into two groups. The following input and output pairs can be defined:

$$y_k = \begin{bmatrix} PR \text{ motor load} \\ PR \text{ blow-line consistency} \\ SR \text{ motor load} \\ SR \text{ blow-line consistency} \end{bmatrix} \quad u_k = \begin{bmatrix} \text{Screw speed} \\ PR \text{ dilution flow} \\ SR \text{ dilution flow} \\ SR \text{ plate gap} \end{bmatrix}$$

where $k = \{l \ldots n\}$ and $n$ is the number of refiner lines.

$$y_q = \begin{bmatrix} CSF \\ MFL \end{bmatrix} \quad u_q = [PR\ Gap_1 \ldots PR\ Gap_n]^T$$

where k={1 . . . n} and n is the number of refiner lines.

As is apparent, the input/output pairing is not restricted to the example listed above but may exist as any combination of the MVs and CVs as listed in Table 1, as dictated by the process configuration.

The above separation also has a strong physical basis. Since the pulp quality is ultimately determined by the operation of the primary refiner, the primary refiner plate gap can be used to regulate the final pulp quality.

This separation of process variables provides a basis for developing a two-level control strategy. The main objectives of the control strategy of the present invention are to: control refiner motor loads, control blow-line consistencies, attenuate wood chip density variations, maximize production rate, and control pulp quality.

Refiner Line Stabilization

The objective of the Stabilization Controller of the present invention is to control $y_k$ by manipulating $u_k$. It is common to observe significant variations in the motor load and blow-line consistencies when $u_k$ is kept constant. These observations confirm that there must be significant mass flow rate disturbances in the chip feed. A constant screw speed is able to provide a constant volumetric flow to the refiner line. However, the refiners operate based on mass throughput. The PR motor load responds almost instantaneously to changes in chip bulk density. The PR motor load can then be used as an indicator of variations in chip bulk density. Any changes in the chip bulk density can also influence the blow-line consistency. Therefore, manipulating the screw speed and PR dilution flow are required to control PR motor load and PR blow-line consistency.

In this control strategy, the volumetric flow to the refiner line is changing but the mass flow rate is kept constant by maintaining a tight control of the PR motor load and blow-line consistency. Maintaining a constant motor load also stabilizes the specific energy (motor load/mass throughput) and maintaining a constant blow-line consistency stabilizes the refining intensity. Stabilization of the specific energy and refining intensity are required to produce high quality TMP pulp. The SR refiner is also affected by the screw speed and PR dilution flow. SR plate gap and SR dilution flow rate are used to regulate the operation of the SR refiner, where the screw speed and PR dilution flow serve as disturbance variables. A real-time algorithm to detect the sign of the gain between motor load and plate gap (or hydraulic pressure) can also be incorporated to prevent fiber cutting and pad collapse. Operating the PR and SR refiners at the maximum allowable motor loads automatically maximizes the production rate.

$$y_k = A_k u_k$$

where $A_k$ is the multivariable dynamic model matrix that corresponds to the $k^{th}$ refiner line.

A control law that is based on the Model Predictive Range Control (MPRC) is used to control each refiner line. In the MPRC formulation, the following cost function is minimized:

$$\min_{\nabla u, y} \left\| \begin{pmatrix} W & & \\ & W_p & \\ & & W_0 \end{pmatrix} \left( \begin{bmatrix} A \\ A_p \\ S_1 \end{bmatrix} \nabla u - \begin{bmatrix} y \\ y_p \\ u_{ss}^{(i)} \end{bmatrix} \right) \right\|^2 + \|\nabla u^T \Lambda \nabla u\|^2$$

$$\text{y_lo} \le y \le \text{y_hi}$$

$$y_p\text{_lo} \le y_p \le y_p\text{_hi}$$

$$\nabla\text{u_lo} \le \nabla u \le \nabla\text{u_hi}$$

$$\text{u_lo} \le S\nabla u \le \text{u_hi}$$

-continued $$S = \begin{bmatrix} 1 & & & & & & & & 0 \\ \vdots & \ddots & & & & & & & \\ 1 & \cdots & 1 & & & & & & \\ & & & 1 & & & & & \\ & & & \vdots & \ddots & & & & \\ & & & 1 & \cdots & 1 & & & \\ & & & & & & \ddots & & \\ & & & & & & & 1 & \\ & & & & & & & \vdots & \ddots \\ 0 & & & & & & & 1 & \cdots & 1 \end{bmatrix}$$

$$S_1 = \begin{bmatrix} 1 & \cdots & 1 & & & & & & \\ & & & 1 & \cdots & 1 & & & \\ & & & & & & \ddots & & \\ & & & & & & & 1 & \cdots & 1 \end{bmatrix}$$

where

A is the dynamic model matrix

W, $W_p$, $W_0$ are diagonal weight matrices.

S is an accumulating-sum matrix.

$S_1$ is a summation matrix.

$A_p$ and $y_p$ are for specifying shaping constraints.

y_hi and y_lo are high and low y bounds.

$\nabla$ is the difference operator (i.e. $\nabla u(t)=u(t)-u(t-1)$)

$\nabla$u_hi and $\Delta$u_lo are high and low MV rate constraints.

u_$h_1$ and u_lo are high and low MV absolute constraints.

$\Lambda$ is the move-penalty matrix.

The novel component of MPRC is the use and design of the control funnel. By specifying y_lo and y_hi for each CV, the shape of the funnel is defined. For a regulatory CV, the funnel tail end narrows down to a single line at the value of the setpoint. For a constraint CV, the funnel tail end opens to the high and low CV limits. In either case, the funnel opening is wider than the tail end to allow some dynamic interaction. With a proper funnel design, the move-penalty term can be removed. As a result, the number of tuning knobs is reduced, and the control performance can be specified directly on a per-CV basis.

Other geometric shapes, such as pipe or stairway, can be used if special control needs warrant them. For most applications in the process industries, a funnel provides a simple tuning parameterization, and yet it is versatile enough for various application needs. If a reference trajectory, y_ref, is preferred, both y_lo and y_hi can be set to y_ref. In this case, a move-penalty term $\nabla u^T \Lambda \nabla u$ can be added to ensure system stability, and the formulation of MPRC reverts to a classic regulatory formulation of MPC. Both regulatory control and constraint control are unified into range control.

Pulp Quality Optimization

The Stabilization Controller is able to improve the operation of the refiner line by stabilizing the PR and SR refiner motor loads and blow line consistencies. The objective of the quality controller then is to maneuver the refiner lines by manipulating the PR plate gap to control the final pulp quality.

Similarly, hydraulic pressure can be manipulated to control the final pulp quality. Blow-line consistency can also be manipulated to control the final pulp quality. While the above example employed the PR gap, it is understood that almost all the MVs will have an impact on the pulp quality. The choice of manipulating the PR plate gap also has some additional benefits as it removes the requirement of the specific energy control loop. It is established that there is a strong correlation between specific energy and pulp quality, however this relationship is not stationary. As wood species, chip bulk density and other process change takes place, the absolute value of specific energy to produce pulp of desired quality can change significantly. By directly manipulating the PR plate gap, the specific energy being applied to process the wood chips is dynamically regulated. For example, to decrease CSF the specific energy would need to be increased. The control strategy would accomplish the increase in the specific energy by taking the following simplified control actions:

Action 1: The Quality Controller would decrease the plate gap to lower CSF. However, as the plate gap decreases the motor load would increase and blow-line consistency would also increase.

Action 2: The Stabilization Controller would regulate the motor load and blow-line consistency by decreasing the screw speed and adjusting the PR dilution as required.

In the above sequence of events the motor load has been maintained constant, yet the screw speed has been decreased. The decreased screw speed also leads to a decrease in the mass throughput and ultimately increases the specific energy.

The input/output relationship for the Quality Controller is defined as, $$y_q = A_q u_q$$

The dynamic model matrix for the quality controller, $A_q$, is identified after the Stabilization Controller loop has been closed. The Quality Controller also uses the MPRC algorithm. For multiple lines the contribution of each refiner line is independently modeled. However, as the combined pulp quality is controlled, some constraints must be defined for each refiner line to maintain each refiner line at its optimal operating point. For example, upper and lower limits on the primary plate gap can be defined, and relative changes in the plate gap between parallel refiner lines can also be defined. Furthermore, upper and lower values for specific energy can also be defined. Note that the refiner line is not controlled to a fixed specific energy target, but can be maintained within a specified range. The exact value of specific energy is dynamically adjusted by the combined effort of the Quality and Stabilization Controllers.

The introduction of the Quality Controller establishes interactions between the Quality Controller and the Stabilization Controller. These interactions are due to the inherent process interaction as the plate gap impacts both primary motor load and pulp quality. In order to take these interactions into account and resolve any conflicts, a three-tier approach is proposed to integrate and coordinate Stabilization and Quality Controllers.

The Optimizer is based on the MPRC design and obtains the steady state solution by solving a distributed quadratic program (See, U.S. Pat. Nos. 6,055,483 and 6,122,555). In the three-tier approach, the top tier is for plant wide optimization that is based on the future process constraints. The middle tier is the coordination "collar" for preventing each controller from receiving a locally infeasible maneuvering command. The bottom tier is a layer of MPRC controllers.

The optimizer is able to utilize the models that are present in the MPRC controllers that are to be coordinated. The process steady state model is defined as:

$$\underbrace{\begin{bmatrix} y_1 \\ \vdots \\ y_n \\ \hline y_q \end{bmatrix}}_{y_g} = \underbrace{\left[\begin{array}{ccc|c} G_1 & & & G_1^f \\ & \ddots & & \vdots \\ & & G_n & G_n^f \\ \hline & & & G_q \end{array}\right]}_{G_g} \underbrace{\begin{bmatrix} u_1 \\ \vdots \\ u_n \\ \hline u_q \end{bmatrix}}_{u_g}$$

where $G_g$ is the global gain matrix and $G_n^f$ is the feed-forward model from $u_q$ to $y_k$. Furthermore, define i={1 . . . n+q}, where n+q represents the total number of MPRC controllers.

$$\min_{u_g} \; f(u_g)$$

$$y_{g_}lo \le G_g u_g \le y_{g_}hi$$

$$u_{g_}lo \le u_g \le u_{g_}hi$$

$$f(u_g) \le c$$

Step 2. For each of the MPRC controllers, find a closest locally feasible point to the global optimum:

$$\min_{u_{ss}^{(i)}} \sum (u_{ss}^{(i)} - u_g^{(i)})^2$$

$$\text{y_lo}(i) \le G^{(i)} u_{ss}^{(i)} \le \text{y_hi}(i)$$

$$\text{u_lo}(i) \le u_{ss}^{(i)} \le \text{u_hi}(i)$$

Step 3. Pass the solution of step 2 to the corresponding i-th controller; use MPRC to accomplish the global coordination and optimization:

$$\min_{\nabla u, y} \left\| \begin{pmatrix} W & & \\ & W_p & \\ & & W_0 \end{pmatrix} \left( \begin{bmatrix} A \\ A_p \\ S_1 \end{bmatrix} \nabla u - \begin{bmatrix} y \\ y_p \\ u_{ss}^{(i)} \end{bmatrix} \right) \right\|^2 + \|\nabla u^T \Lambda \nabla u\|^2$$

$$\text{y_lo} \le y \le \text{y_hi}$$

$$y_p\text{_lo} \le y_p \le y_p\text{_hi}$$

$$\nabla\text{u_lo} \le \nabla u \le \nabla\text{u_hi}$$

$$\text{u_lo} \le S\,\nabla u \le \text{u_hi}$$

In step 1, the first two sets of constraints, $y_lo \leqq Gu_g \leqq y_hi$ and $u_lo \leqq u_g \leqq u_hi$, represent the composition of all the constraints that are transferred from each of the MPRC controllers. $G_g$ in the first set of constraints is the global gain matrix. With this constraint transfer, the optimizer will honor the same set of constraints within which the MPRC controllers try to control. Additional linear or nonlinear constraints can be included in the third constraint set. In step 2, the two sets of constraints, $cv_lo^{(i)} \leqq G^{(i)} u_{ss}^{(i)} \leqq cv_hi^{(i)}$ and $mv_lo^{(i)} \leqq u_{ss}^{(i)} \leqq mv_hi^{(i)}$, represent the constraints corresponding to those in the i-th controller at the end of its prediction horizon. Matrix $G^{(i)}$ is the model gain for the i-th controller, which also equals the i-th diagonal block in matrix $G_g$.

Step 2 is a coordination collar, through which the MPRC controller can be protected from receiving a locally infeasible maneuvering destination. Note that a globally feasible solution may not be feasible to a local controller. The coordination collar provides a way to protect the "local interest," and, in fact, favors the local interest the most. If it is preferable to balance the local and global interests, an objective function could be constructed that would trade off the local interest for the global considerations. Notice that the local and global interests always converge at the end of the optimization horizon, and that the conflict arises only in transient.

Figure 3:
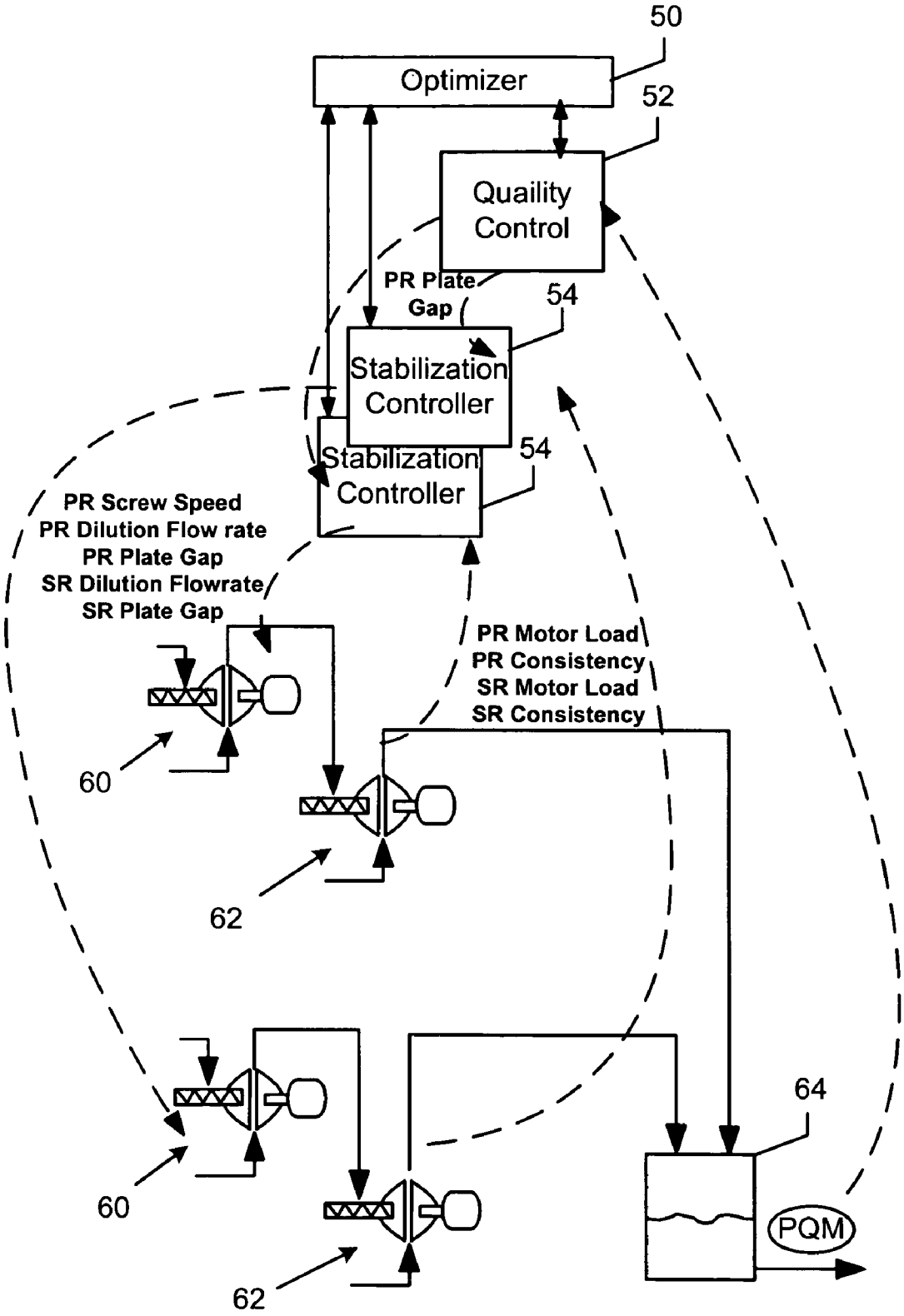
FIG. 3 illustrates a control structure that uses global optimization.

FIG. 3 illustrates the resulting control structure that uses global optimization. The entire TMP process includes a primary refiner 60 and a secondary 62 that empties in a latency chest 64. The stabilizer controller 54 handles the fast dynamics, the Quality Controller 52 handles the slow dynamics and the Optimizer 50 integrates and/or coordinate the Stabilizer Controller 54 and the Quality Controller 52 to control the entire TMP process.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

The invention claimed is:

1. A system to support centralized control for a thermo-mechanical pulp (TMP) refining process that yields pulp which comprises a fibrous mass, comprising:

means for handling the fast dynamics of the TMP refining process via one or more stabilization controllers that regulate refiner line motor loads and blow-line consistencies;

means for handing the slow dynamics of the TMP refining process via one or more quality controllers that regulates final pulp quality; and means for integrating and/or coordinating the one or more stabilization and quality controllers to control the entire TMP refining process via an optimizer and wherein the one or more stabilization controllers are independently controlled from the one or more quality controllers and wherein execution frequency of the one or more stabilization controllers is independently selected from that of the one or more quality controllers.

2. The system of claim 1, wherein:

the optimizer is further operable to:

generate a steady state global optimal solution based on a set of constraints;

find a closest locally feasible point to the global optimal solution for each of the one or more stabilization and quality controllers; and and pass the closest locally feasible point the corresponding controller.

3. The system of claim 2, wherein:

the global optimal solution is obtained using distributed quadratic program method.

4. The system of claim 1, wherein:

each of the one or more stabilization and quality controllers is a constrain-model-based predictive control (MPG) controller.

5. The system of claim 1, wherein: each of the one or more stabilization and quality controllers is based on Model Predictive Range Control (MPRC) algorithm.

6. The system of claim 1, wherein:

each of the one or more stabilization and quality controllers has multiple manipulated and/or controlled variables.

7. The system of claim 6, wherein:

each manipulated variable is one of: screw speed, primary refiner (PR) dilution flow, PR plate gap, secondary refiner (SR) dilution flow, and SR plate gap.

8. The system of claim 6, wherein:

each controlled variable is one of: PR motor speed, PR blow-line consistency, SR motor speed, SR blow-line consistency, final pulp quality, PR blow-line pulp quality, and SR blow-line pulp quality.

9. The system of claim 6, wherein:

the value of each of the multiple manipulated and controlled variables is limited by an upper and/or lower bound.

* * * * *